US005577935A

United States Patent [19]

Harting et al.

[11] Patent Number: 5,577,935

[45] Date of Patent: Nov. 26, 1996

[54] COAXIAL, ANGULAR CONNECTOR FOR INSTALLATION ON A PRINTED CIRCUIT BOARD

[75] Inventors: Dietmar Harting, Espelkamp; Guenter Pape, Bielefeld; Gerd Weking, Loehne, all of Germany

[73] Assignee: Harting Elektronik GmbH, Espelkamp, Germany

[21] Appl. No.: 490,033

[22] Filed: Jun. 13, 1995

[30] Foreign Application Priority Data

Nov. 3, 1994 [DE] Germany ..... 44 38 872.1

[51] Int. Cl.[6] ..... H01R 9/05

[52] U.S. Cl. ..... 439/581; 439/578

[58] Field of Search ..... 439/579, 578, 439/63, 108, 581

[56] References Cited

U.S. PATENT DOCUMENTS 5,169,343 12/1992 Andrews ..... 439/581 X 5,348,491 9/1994 Louwagie et al. ..... 439/579 X

*Primary Examiner*—Jes F. Pascua

*Attorney, Agent, or Firm*—Jordan and Hamburg

[57] ABSTRACT

For a coaxial angular connector with at least two coaxial contacts for installation on a printed circuit board, with a housing block assembled from two subshells, in the interior of which the neutral wires of the coaxial contacts are taken from a plug connection side to a terminal side on the printed circuit board, it is proposed that two mutually overlapping partitions or shielding walls be provided between the neutral wires for their mutual shielding. Due to the overlapping of the partitions, the joint gap of the two half shells between the neutral wires is constructed as a labyrinth impermeable to high frequency radiation.

16 Claims, 3 Drawing Sheets

COAXIAL, ANGULAR CONNECTOR FOR INSTALLATION ON A PRINTED CIRCUIT BOARD

BACKGROUND OF THE INVENTION

The invention relates to a coaxial angular connector for installation on a printed circuit board with at least two coaxial contacts which, on the one hand have a plug connection end and, on the other, a terminal end for attachment and contacting in printed circuit boreholes, the coaxial contacts being disposed in an electrically conductive housing assembled from two subshells or half shells, the neutral wires of the coaxial contacts, insulated electrically against the subshells, being led through recesses in the interior of the subshells and a wall being provided between the neutral wires, which shields the latter electrically from one another.

Such angular connectors are used for the plug-in type of connection between a coaxial multipin connector and a printed circuit board. Optionally, several of the modular angular connectors are disposed sequentially in an insulated housing on the printed circuit board. At the same time, it must be ensured that there is satisfactory shielding of the coaxial contacts, that is, of their neutral wires with respect to one another within the housing block. Moreover, the modular angular connectors should have as small and as space-saving a construction as possible.

From the EP 0 613 215 A1, coaxial angular connectors are known, which have a modular housing block assembled from two subshells, in which the neutral wires of the coaxial contacts are shielded from one another within the block by a wall or wall parts. In the case of this arrangement, which is satisfactory by and large, the shielding wall is formed by two superimposed subwalls of each half shell. At the same time, however, there is a gap—even though it is only a narrow gap—at the point of separation or at the jointing place between adjacent neutral wires, so that the high-frequency shielding between the two neutral wires is interrupted and cannot be regarded as optimum and adequate for all applications.

SUMMARY OF THE INVENTION

It is an object of the invention to improve an angular connector of the above-named type so that improved shielding of the neutral wires of the coaxial contacts is achieved within the modular housing block of the angular connector.

This objective is accomplished owing to the fact that the subshells in each case have a partition running between the neutral leads of the coaxial contacts and that the height of the partitions and their geometric arrangement is dimensioned so that the partitions overlap when the subshells are assembled.

The advantages achieved with the invention consist particularly therein that a satisfactory, high-frequency shielding of neighboring neutral wires from one another is achieved within the housing block. The improved shielding is based on the fact that the gap between neighboring neutral wires, which arises when the two subshells are assembled, does not proceed in a straight line between the neutral wires, but forms, as it were, a labyrinth, mutual interaction between neighboring neutral wires from a high-frequency point of view being precluded.

In order to prevent any high-frequency emission from the neutral wires also to the outside (of the angular connector/housing block), provisions can be made so that the one subshell has external, protruding walls, which engage corresponding recesses in the other subshell. Here also, there is then a labyrinth instead of a smooth, continuous gap to the outside. By these means, high-frequency interfering radiation is, of course, also prevented from acting from outside on the neutral wire.

An example of the invention is explained in greater detail in the following and shown in the accompanying drawing.

DESCRIPTION OF THE PREFERRED EMBODIMENTS

Figure 3:
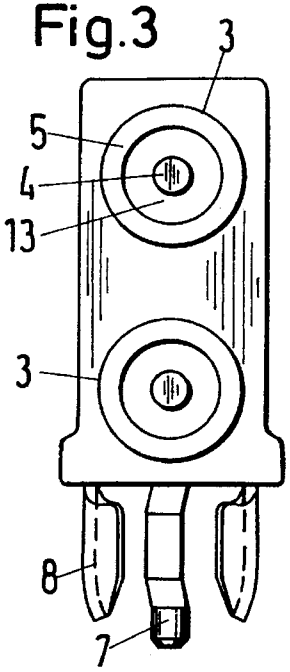
FIG. 3 shows a side view of the angular connector
Figure 1:
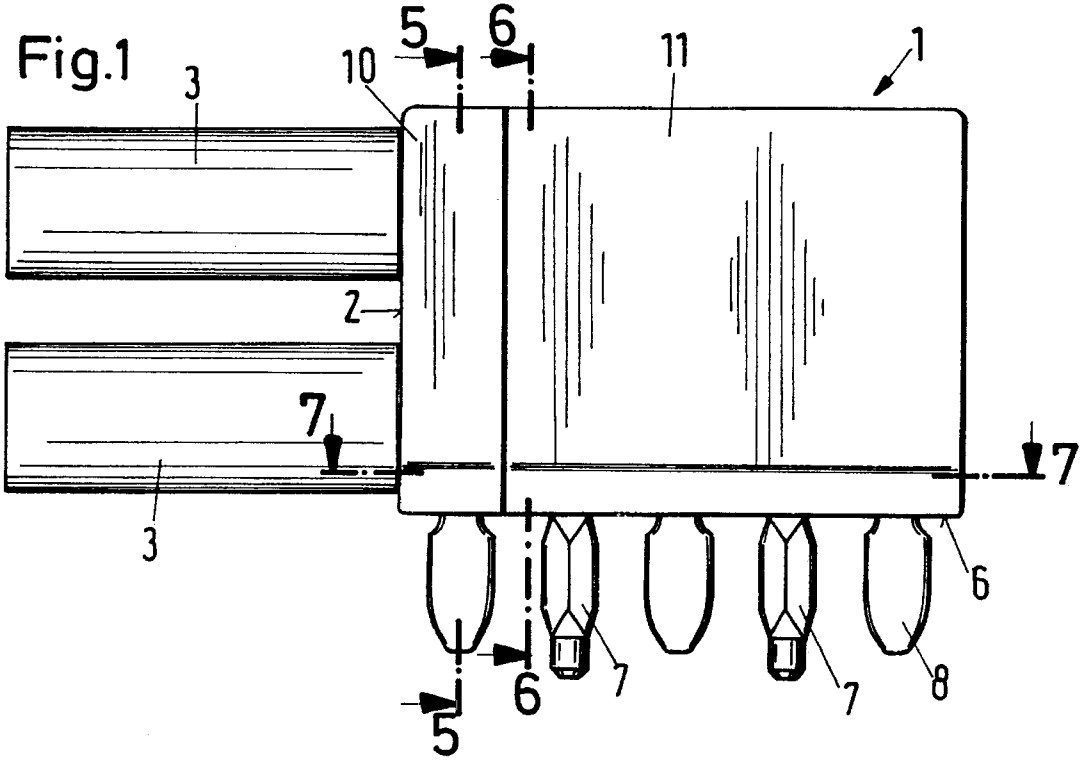
FIG. 1 shows a view of the angular connector.
Figure 2:
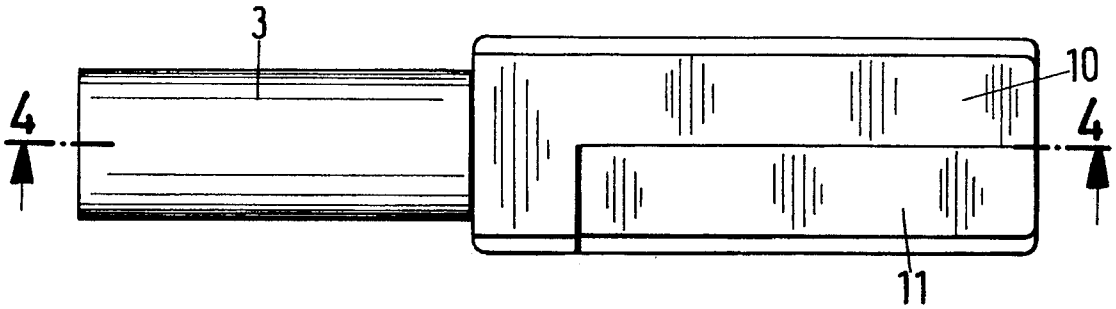
FIG. 2 shows a plan view of the angular connector.

The angular connector, shown in FIGS. 1 to 4, consists essentially of a flat, rectangular housing block 1, out of the narrow side face 2 of which two coaxial contacts 3 protrude, which are constructed as known, coaxial, plug connections with a neutral wire 4 and a contacting and shielding sleeve 5 surrounding the latter.

From the underside 6 of the housing block, terminal posts 7 protrude at right angles to the coaxial contacts 3. They are formed for pressing into metallized boreholes of a printed circuit board, the details of which are not shown here. These terminal posts are in each case connected with the neutral wires 4 of the coaxial contacts or integrally molded in one piece with it.

Further terminal posts 8 are integrally molded to a metallic base or grounding plate 9, and the base plate itself is anchored in the underside of the housing block 1 and connected electrically with the latter. The housing block 1 consists of two flat half shells or subshells 10, 11, preferably of a metallic material, which are joined and firmly connected with one another by means of rivet pins, the details of which are not shown here. The subshells 10, 11 optionally can also be made from a plastic material, in which case, however, their surfaces are provided with a metallization all around (on the inside and on the outside).

The subshells are provided on their inside with recesses 12, 12', in which the neutral wires 4 and an insulating sleeve 13, 13' surrounding the latter are accommodated as a dielectric.

Figure 4:
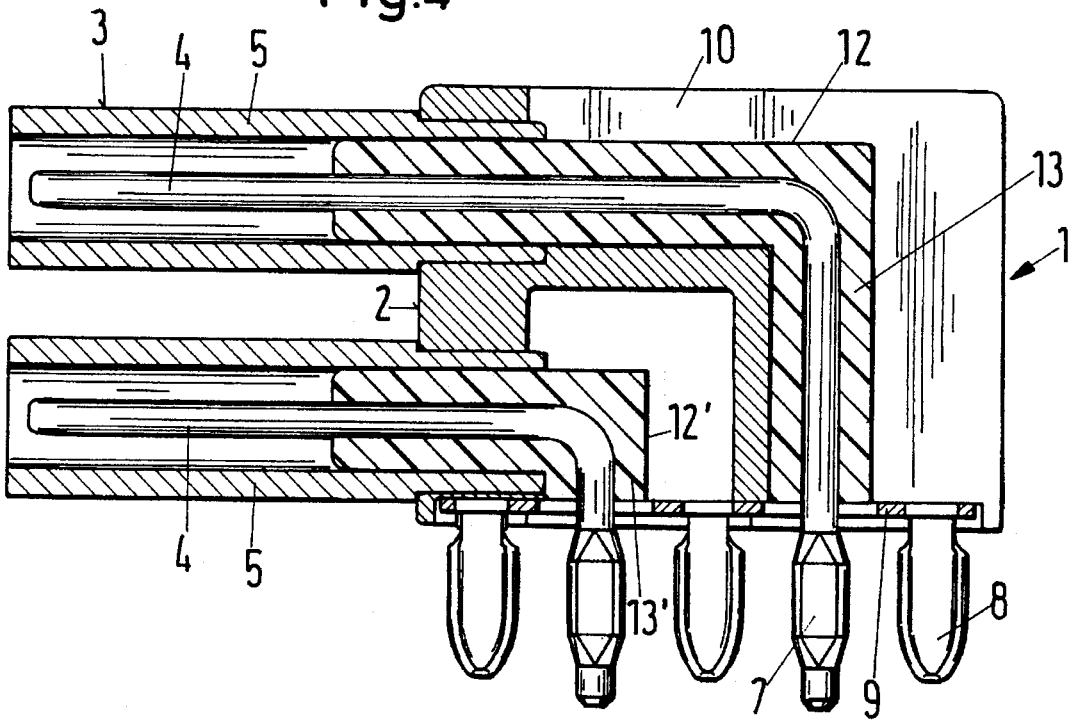
FIG. 4 shows a sectional view of the angular connector taken along the line 4—4, in FIG. 2.
Figure 5:
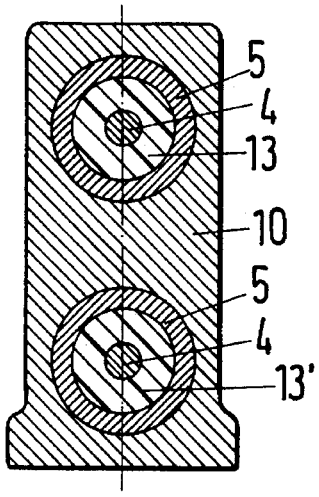
FIG. 5 shows a sectional view of the angular connector taken along the line 5—5, in FIG. 1.

In the front housing of the subshell 10, the shielding sleeves 5 are pressed into appropriate boreholes in the side face 2, as shown in FIG. 4 and as can be seen in the sectional representation of FIG. 5. In this connection, the shielding sleeves are connected mechanically and electrically with the subshell.

Each subshell is provided in the region or separation space between the neutral wires 4 with a wall or partition 14, 15, the height of which extends beyond the center line or parting plane 16 of the housing block. The two walls are disposed in such a manner, that they are adjacent to one another and overlap one another after the subshells are assembled, as can be seen in the sectional representation of FIGS. 6 and 7. For the sake of completeness, it should be mentioned that the walls extend along the course of the neutral wire in the region of the side faces 2 up to the region of the underside 6. By these means, it is achieved that the joint gap 17, 17', 17", which results when the subshells are assembled, does not run in a straight line between the neutral wires 4, but is constructed in the form of a labyrinth. A high-frequency emission, emanating from the neutral wires, can then not reach one neutral wire from another, so that satisfactory mutual shielding is present.

Figure 6:
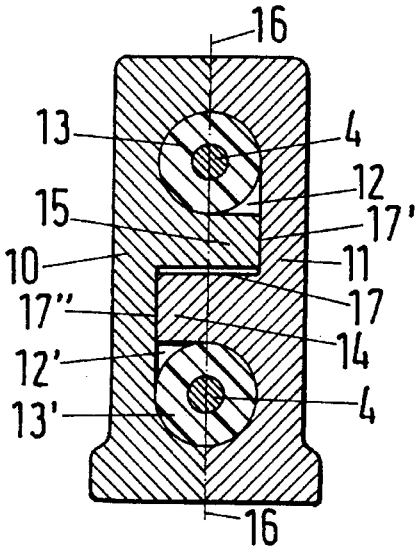
FIG. 6, shows a sectional view of the angular connector taken along the line 6—6, in FIG. 1.
Figure 7:
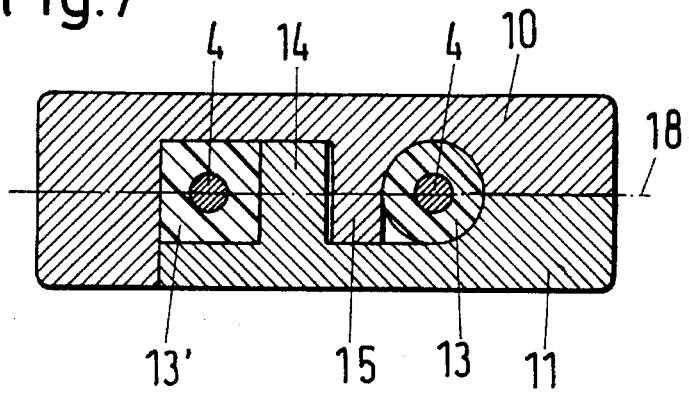
FIG. 7 shows a sectional views of the angular connector taken along the line 7—7 in FIG.1.

For the sectional representation shown in FIG. 7, similar, high-frequency relationships also arise in a plane, which lies at right angles to the sectional plane of FIG. 6. The height of the walls 14, 15, which are adapted to the angular course of the neutral wire 4, is such that the walls protrude beyond the center line or parting plane 18 of the housing block.

Figure 8:
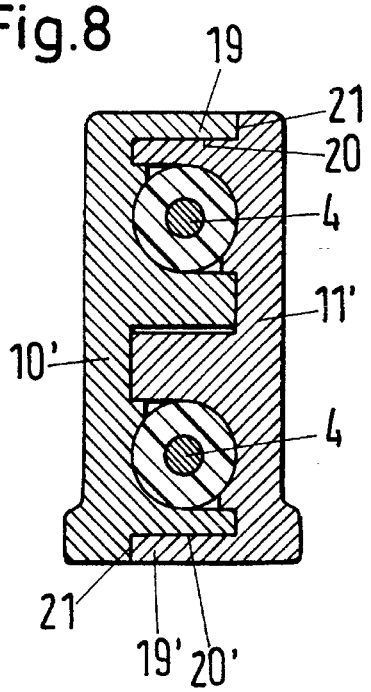
FIGS. 8 and 9 show sectional views of an angular connector with modified subshells.
Figure 9:
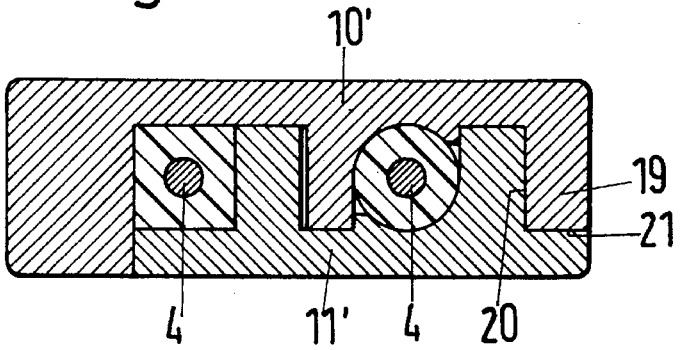

Finally, in the sectional representations of FIGS. 8 and 9, a housing block with modified subshells 10', 11' is shown, the cutting planes corresponding to those of FIGS. 6 and 7. Provisions are made here that, in the outer region of the subshell 10' or 11', parallel to the course of the neutral wire 4, a protruding wall 19, 19' is formed which, when the subshells are assembled, dips into or is inserted into a corresponding recess 20 of the subshell 11'or recess 20' of the subshell 10'. By these means, it is achieved that the outwardly pointing joint gap 21 between the two subshells, starting out from the neutral wire 4, also does not proceed to the outside in a straight line but is constructed in the form of a labyrinth, so that high frequency emissions, emanating from the neutral wire, cannot reach the outside and interfering high frequency radiation cannot reach the neutral wires from the outside.

We claim:

1. A coaxial connector adapted to be installed on a printed circuit board comprising two subshells which together form an electrically conductive housing means, at least two coaxial contacts in said housing means, each of said two coaxial contacts having one end formed as a plug connection and the other end formed as a terminal end for attachment to a printed circuit board, each of said coaxial contacts comprising a central wire and insulation means disposed about said central wire, each of said subshells having interior recesses in which said coaxial contacts are received, each of said two coaxial contacts being spaced from one another such that the insulation means of each coaxial contacts are separated from one another by a separation space, each of said central wires of each coaxial contacts having a central axis with the central axis of each central wire being disposed in a common plane with said common plane passing through said separation space, each of said subshells having partitions which extend into said separation space and which extend through said common plane such that the partition of each subshell overlaps one another in said separation space.

2. A coaxial connector according to claim 1 wherein said partitions are formed as a labyrinth impermeable to high frequency radiation.

3. A coaxial connector according to claim 1 wherein each of said partitions have a length measured perpendicular to said common plane which is at least as great as the diameter of said insulation means.

4. A coaxial connector according to claim 1 wherein the combined thickness of said two partitions in said separation space measured in said common plane is substantially equal to the width of said separation space measured in said common plane.

5. A coaxial connector according to claim 1 wherein said subshells are made of metal.

6. A coaxial connector according to claim 1 wherein said subshells are made of a plastic material coated with an electrically conductive material.

7. A coaxial connector according to claim 1 wherein said housing means has an outer housing portion disposed on the outer side of one of said coaxial contacts which is diametrically opposite to the side on which said separation space is disposed, each of said subshells having a second partition which together form said outer housing portion, each of said second partitions extending through said common plane such that said second partitions of said subshells overlap one another in said common plane in forming said outer housing portion.

8. A coaxial connector according to claim 7 wherein said second partitions are formed as a labyrinth impermeable to high frequency radiation.

9. A coaxial connector according to claim 7 wherein said housing means has a second outer housing portion disposed on the outer side of the other of said coaxial contacts which is diametrically opposite to the side on which said separation space is disposed, each of said subshells having third partitions which together form said second outer housing portion, each of said third partitions extending through said common plane such that said third partitions of said subshells overlap one another in forming said second outer housing portion.

10. A coaxial connector according to claim 9 wherein said third partitions are formed as a labyrinth impermeable to high frequency radiation.

11. A coaxial connector according to claim 1 wherein said housing means has an outer housing portion disposed on the outer side of one of said coaxial contacts which is diametrically opposite to the side on which said separation space is disposed, each of said subshells having an outer section which together form said outer housing portion, each of said outer sections of each subshells mating with one another at said common plane.

12. A coaxial connector according to claim 1 wherein said housing means has an outer housing portion disposed on the outer side of one of said coaxial contacts which is diametrically opposite to the side on which said separation space is disposed, one of said subshells having an outer section which forms said outer housing portion, said outer section of said one subshell passing through said common plane.

13. A coaxial connector according to claim 1 wherein each of said coaxial contacts has an L-shaped configuration.

14. A coaxial connector according to claim 1 wherein said insulation means has an outer cross sectional circular configuration.

15. A coaxial connector according to claim 1 wherein said insulation means has an outer square cross sectional configuration.

16. A coaxial connector adapted to be installed on a printed circuit board comprising two subshells which together form an electrically conductive housing means, at least two coaxial contacts in said housing means, each of said coaxial means comprising a central wire and insulation means disposed about said central wire, each of said two coaxial contacts being spaced from one another by a separation space, each of said central wires of each coaxial contacts having a central axis with the central axis of each central wire being disposed in a common plane with said common plane passing through said separation space, a labyrinth extending into said separation space and which is impermeable to high frequency radiation, said labyrinth comprising portions on said subshells which extend into said separation space and which pass through said common plane such that the partition of each subshell overlaps one another in said separation space.

* * * * *